US009955774B1

(12) United States Patent
Chuang

(10) Patent No.: US 9,955,774 B1
(45) Date of Patent: May 1, 2018

(54) BACKPACK

(71) Applicant: Jung-Hua Chuang, Taichung (TW)

(72) Inventor: Jung-Hua Chuang, Taichung (TW)

( * ) Notice: Subject to any disclaimer, the term of this patent is extended or adjusted under 35 U.S.C. 154(b) by 0 days. days.

(21) Appl. No.: 15/335,969

(22) Filed: Oct. 27, 2016

(51) Int. Cl.
*A45F 3/04* (2006.01)
*A45F 3/00* (2006.01)

(52) U.S. Cl.
CPC ..... *A45F 3/04* (2013.01); *A45F 2003/001* (2013.01)

(58) Field of Classification Search
CPC ..... A45F 2003/122; A45F 2003/125; A45F 3/04; A45F 2003/127; A45F 3/08; A45F 2003/003; A45F 2003/166; A43B 7/06; A43B 7/082; A42B 3/285; A41D 13/0053; A41D 13/0056
See application file for complete search history.

(56) References Cited

U.S. PATENT DOCUMENTS 4,417,407 A * 11/1983 Fukuoka ..... A43B 7/082 36/29
2003/0167559 A1* 9/2003 How ..... A41D 13/0053 2/458
2008/0121674 A1* 5/2008 Yang ..... A45F 3/04 224/644
2016/0206018 A1* 7/2016 Barbret ..... A41D 13/0053

* cited by examiner

*Primary Examiner* — Adam Waggenspack

(57) ABSTRACT

A backpack includes two sheets, two straps and a moisture-expelling apparatus. The sheets are connected to each other. The straps are connected to one of the second sheet. The moisture-expelling apparatus includes a permeable bag, a pump and a tube. The permeable bag is attached to the second sheet. The pump is inserted in the permeable bag. The pump can be squeezed to release air and can automatically expand to suck air when the squeezing stops. The tube is inserted in the permeable bag. The tube is connected to the pump so that air travels into the tube from the pump when the pump is squeezed and that air travels into the pump from the tube when the pump expands. The tube includes apertures via which air can enter and leave the tube.

10 Claims, 3 Drawing Sheets

BACKPACK

BACKGROUND OF INVENTION

Field of Invention

The present invention relates to a backpack and, more particularly, to a backpack for expelling moisture from a gap between the backpack and a user's back.

RELATED PRIOR ART

A user carries stuff in a backpack without having to carry the stuff by his or her hands. His or her hands are available for tasks. Therefore, a backpack is very useful and important for a traveler and, more particularly, for a hiker or a climber. The user inevitably sweats no matter whether he or she is walking, hiking or climbing. Moisture tends to stay between the user's back and the backpack since there is limited space between the user's back and the backpack. The lingering moisture makes the user feel uncomfortable.

There has been a backpack with rib-like portions that is designed to contact a user's back to leave a relatively large space between the user's back and the backpack. The relatively large space allows better release of moisture from the user's back. The rib-like portions are soft to provide a nice feel for the user. However, the soft rib-like portions tend to be deformed and brought into close contact with the user's back, thereby reducing the space between the user's back and the backpack. The expelling of the moisture is compromised. Moreover, the release of the moisture is not efficient because it depends on natural flow of air alone.

Another backpack includes two arched elements and a net that is designed to contact a user's back while the arched elements are designed to keep the backpack away from the user's back to leave an even larger space between the user's back and the backpack. The net allows excellent release of moisture from the user's back. The arched elements are made of metal and hence effective in keeping the backpack away from the user's back, thereby keeping a large space between the user's back and the backpack. However, the release of the moisture from the space is not efficient because it depends on natural flow of air alone.

The present invention is therefore intended to obviate or at least alleviate the problems encountered in prior art.

SUMMARY OF INVENTION

It is the primary objective of the present invention to provide a backpack for efficiently expelling moisture from a user's back.

To achieve the foregoing objective, the backpack includes two sheets, two straps and moisture-expelling apparatus. The sheets are connected to each other. The straps are connected to one of the second sheet. The moisture-expelling apparatus includes a permeable bag, a pump and a tube. The permeable bag is attached to the second sheet. The pump is inserted in the permeable bag. The pump can be squeezed to release air and can automatically expand to suck air when the squeezing stops. The tube is inserted in the permeable bag. The tube is connected to the pump so that air travels into the tube from the pump when the pump is squeezed and that air travels into the pump from the tube when the pump expands. The tube includes apertures via which air can enter and leave the tube.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
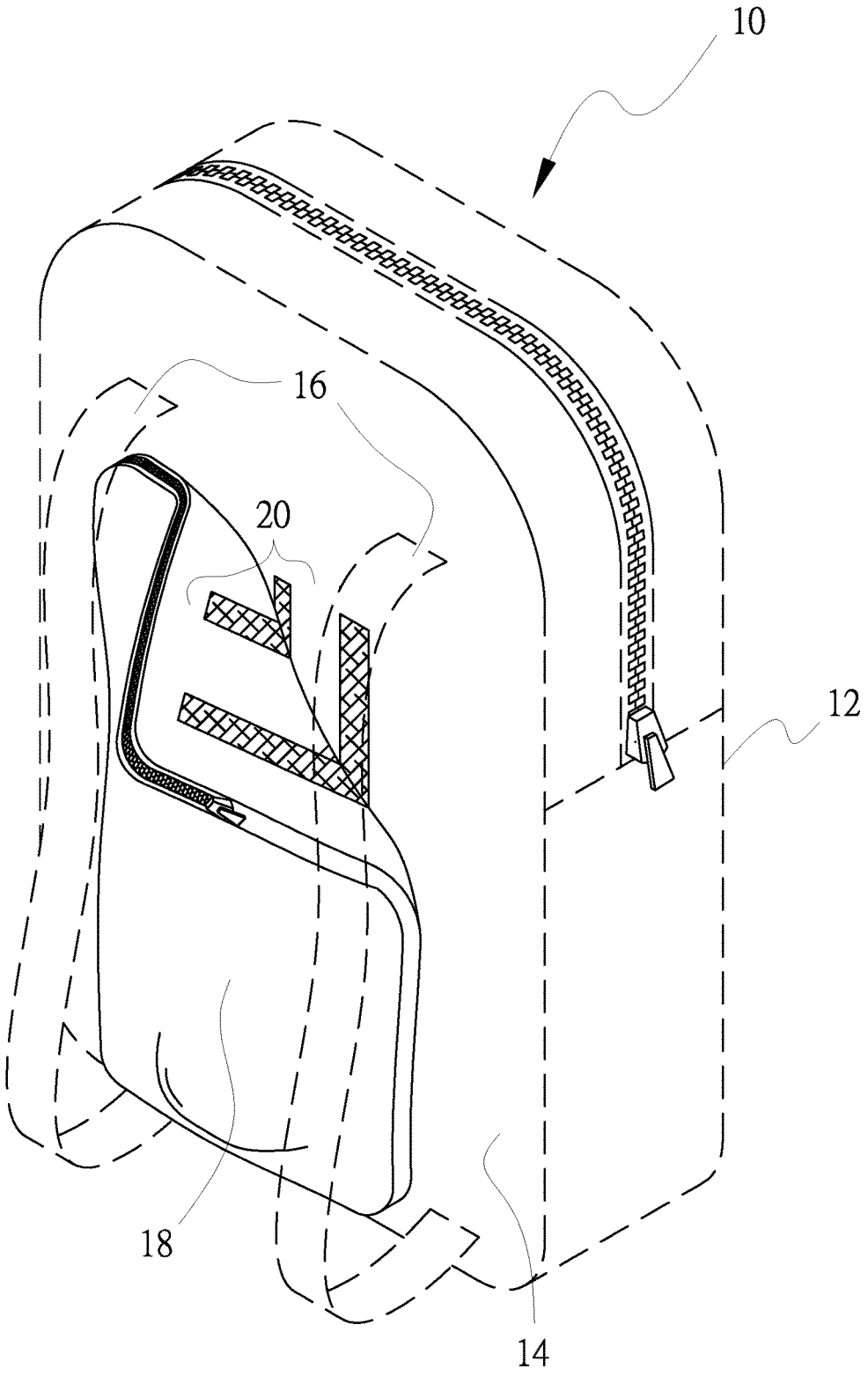
FIG. 1 is a perspective view of a backpack according to the preferred embodiment of the present invention.

Referring to FIG. 1, a backpack 10 includes two sheets 12 and 14, two straps 16, a moisture-expelling apparatus 18 and a connector 20 according to the preferred embodiment of the present invention. The sheets 12 and 14 are preferably connected to each other by sewing. The straps 16 are preferably connected to the sheet 14 by sewing. The moisture-expelling apparatus 18 is preferably connected to the sheet 14 by the connector 20. The connector 20 is preferably hook-and-loop means. The connector 20 can be any other proper means in another embodiment.

Figure 2:
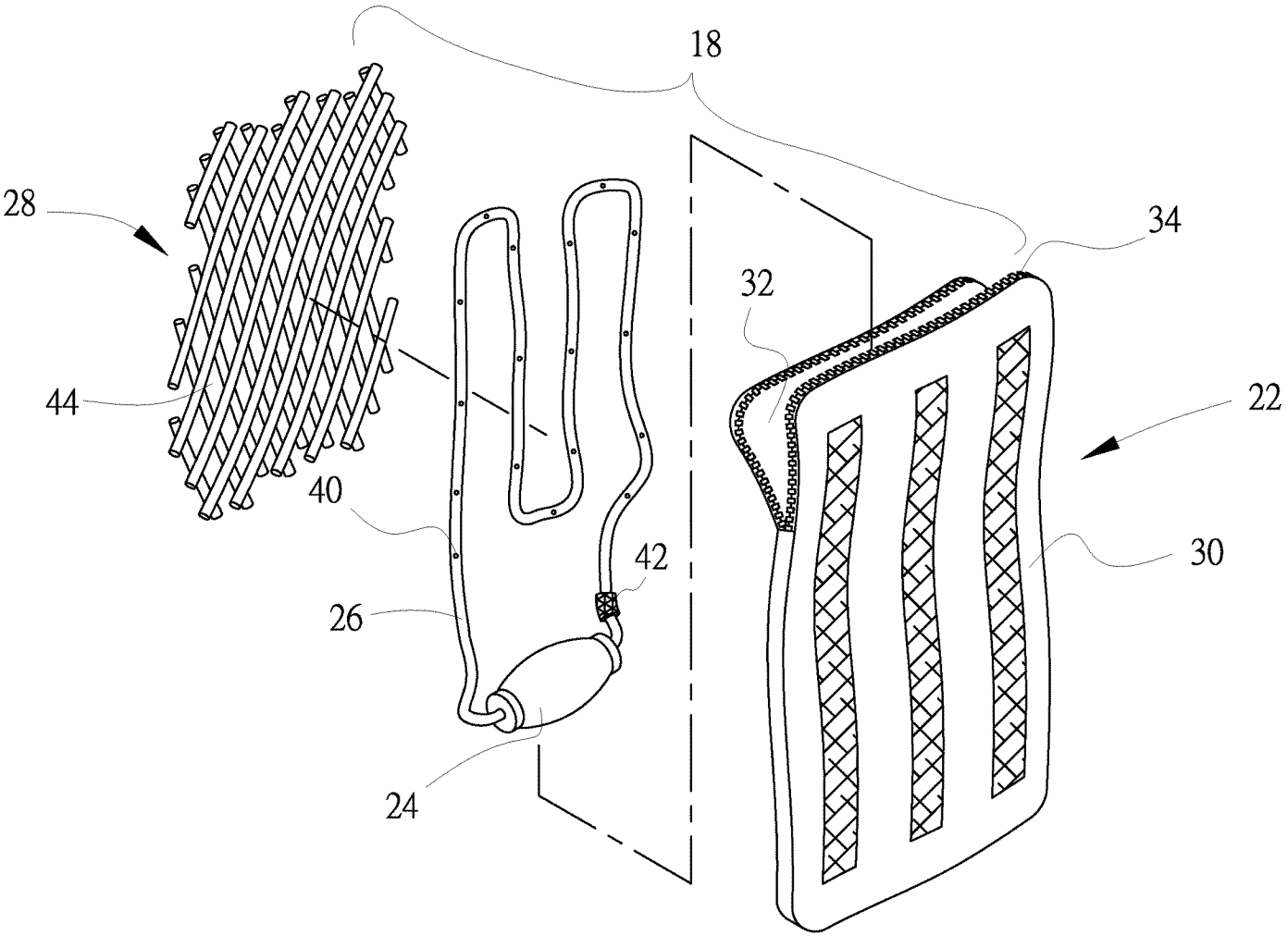
FIG. 2 is an exploded view of the backpack shown in FIG. 1.
Figure 3:
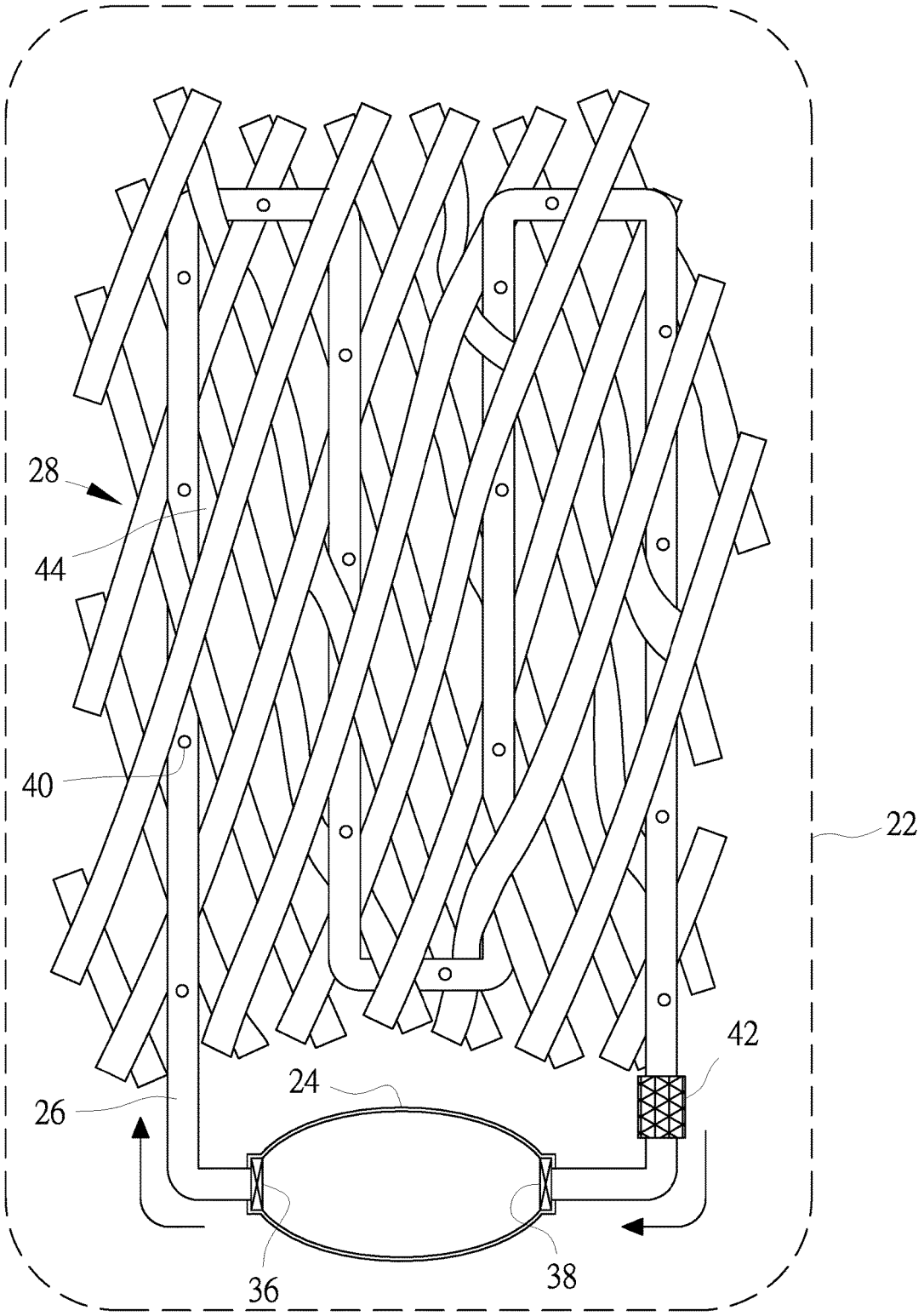
FIG. 3 is a view of a pump, a tube and a pad of the backpack shown in FIG. 1.

Referring to FIGS. 2 and 3, the moisture-expelling apparatus 18 includes a permeable bag 22, a pump 24, a tube 26 and a pad 28. The permeable bag 22 includes two pieces 30 and 32. The pieces 30 and 32 are preferably connected to each other by sewing. At least the piece 32 is in the form of a net through which air travels freely. There is an opening (not numbered) between the pieces 30 and 32. The permeable bag 22 further includes a closing element 34 operable to close the opening of the permeable bag 22. The closing element 34 is hook-and-loop means, a zipper or any other proper element. In use, the piece 30 is connected to the sheet 14 by the connector 20.

The pump 24 is preferably made of an elastic material so that it can be squeezed and can expand due to inherent elasticity when the squeezing stops. The pump 24 is preferably in the form of a rugby ball that includes two opposite ends. A check valve 36 is inserted in and connected to one of the ends of the pump 24 to allow air to leave the pump 24 but not vice versa. Another check valve 38 is inserted in and connected to the other end of the pump 24 to allow air to enter the pump 24 but not vice versa.

As discussed above, the pump 24 is an elastic manual pump with two check valves. However, the pump 24 can be an electronic pump in another embodiment.

The tube 26 includes two ends each connected to a corresponding one of the check valves 36 and 38. The tube 26 further includes a plurality of apertures 40 arranged between the ends thereof. A filter 42 is provided on the tube 26 near the check valve 38.

The pad 28 is preferably a net that is made of strings that are made of an elastic material. The pad 28 can be any other proper element such as a pad of a foam material in another embodiment. The pad 28 includes a plurality of apertures 44. The tube 26 is connected to the pad 28 by inserting various sections of the tube 26 in the apertures 44 of the pad 28.

The pump 24, the tube 26 and the pad 28 are inserted in the permeable bag 22 through the opening of the permeable bag 22. Then, the closing element 34 is operated to close the opening of the permeable bag 22, thereby retaining the pump 24, the tube 26 and the pad 28 in the permeable bag 22.

In operation, the backpack 10 is carried on a user's back. The moisture-expelling apparatus 18 is located in a gap between the user's back and the backpack 10. Air is pumped into the tube 26 from the pump 24 via the check valve 36 when the pump 24 is squeezed between the user's back and the backpack 10 due to action of the user. The air is released from the tube 26 via the apertures 40. Then, the air carries moisture from a gap between the user's back and the backpack 10. Fresh air is pumped into the pump 24 from the exterior via the tube 26 and the check valve 38 when the pump 24 expands due to the inherent elasticity. The filter 42 filters air before the air enters the pump 24. The foregoing process can be repeated to continuously expel moisture from the gap between the user's back and the backpack 10, thereby keeping the user's back dry and comfortable.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A backpack comprising:

a first sheet;

a second sheet connected to the first sheet;

two straps connected to the second sheet;

a moisture-expelling apparatus comprising:

a permeable bag attached to the second sheet;

a pump inserted in the permeable bag, wherein the pump can be squeezed to release air and can automatically expand to suck air when the squeezing stops; and a tube inserted in the permeable bag, connected to the pump so that air travels into the tube from the pump when the pump is squeezed and that air travels into the pump from the tube when the pump expands, and formed with apertures via which air can enter and leave the tube.

2. The backpack according to claim 1, further comprising a connector for attaching the permeable bag to the second sheet.

3. The backpack according to claim 2, wherein the connector comprises hook-and-loop means.

4. The backpack according to claim 1, wherein the permeable bag comprises a first piece attached to the second sheet and a second piece connected to the first piece, wherein the second piece is a net.

5. The backpack according to claim 4, wherein the permeable bag further comprises a closing element arranged between the first and second pieces.

6. The backpack according to claim 5, wherein the closing element comprises a zipper.

7. The backpack according to claim 1, wherein the pump comprises two ends, and the tube comprises two ends connected to the ends of the pump.

8. The backpack according to claim 7, further comprising:

an output check valve arranged between one of the ends of the pump and a corresponding one of the ends of the tube; and an inlet check valve arranged between the other end of the pump and the other end of the tube.

9. The backpack according to claim 1, further comprising a pad inserted in the permeable bag and made with apertures for receiving sections of the tube.

10. The backpack according to claim 9, wherein the pad comprises a net.

* * * * *